United States Patent [19]

Engebretson et al.

[11] Patent Number: 4,988,333

[45] Date of Patent: Jan. 29, 1991

[54] IMPLANTABLE MIDDLE EAR HEARING AID SYSTEM AND ACOUSTIC COUPLER THEREFOR

[75] Inventors: A. Maynard Engebretson, Ladue; John Fredrickson, Clayton, both of Mo.

[73] Assignee: Storz Instrument Company, St. Louis, Mo.

[21] Appl. No.: 242,365

[22] Filed: Sep. 9, 1988

[51] Int. Cl.[5] ..... H04R 25/00

[52] U.S. Cl. ..... 600/25; 128/420.6

[58] Field of Search ..... 128/1.6, 420.6; 600/25; 381/68, 68.6; 623/10, 12

[56] References Cited

U.S. PATENT DOCUMENTS

| | | | |
|---|---|---|---|
| 622,328 | 4/1899 | Collins | 381/68 |
| 3,346,704 | 10/1967 | Mahoney | 600/25 |
| 3,633,217 | 1/1972 | Lance | 623/3 |
| 3,676,611 | 7/1972 | Stephens | 381/68.6 |
| 3,763,333 | 10/1973 | Lichownsky | 381/68 |
| 3,771,173 | 11/1973 | Lamb, Jr. | 623/3 |
| 3,842,440 | 10/1974 | Karlson | 623/3 |
| 3,919,722 | 11/1975 | Harmison | 600/17 |
| 3,974,825 | 8/1976 | Normann | 128/419 R |
| 4,143,661 | 3/1979 | LaForge et al. | 623/3 |
| 4,213,207 | 7/1960 | Wilson | 623/3 |
| 4,357,497 | 11/1982 | Hochmair et al. | 608/35 |
| 4,358,539 | 1/1983 | Robinson et al. | 623/3 |
| 4,428,377 | 1/1984 | Zollner et al. | 128/420.006 |
| 4,441,210 | 4/1984 | Hochmair et al. | 128/420.006 |
| 4,542,532 | 9/1985 | McQuilkin | 455/78 |
| 4,611,598 | 9/1986 | Hortmann et al. | 128/419 R |
| 4,662,358 | 5/1987 | Farrar et al. | 600/17 |
| 4,665,896 | 5/1987 | LaForge et al. | 600/17 |
| 4,666,443 | 5/1987 | Portner | 623/3 |

OTHER PUBLICATIONS

Pamphlet #SPA-1238, "An Introduction to the Cochlear Implant," Univ. of California, School of Medicine, Dept. of Otolaryngology, Coleman & Epstein Laboratories and Storz Instrument Company, 1984.

*Primary Examiner*—William E. Kamm

*Attorney, Agent, or Firm*—Brooks & Kushman

[57] ABSTRACT

The acoustical coupler has a closed-bottom containment with compliant diaphragm attached to the containment periphery to form an acoustic chamber. A length of tubing is connected through the side or bottom of the containment to the chamber for conveying sound pressure between the chamber and an electroacoustic transducer connected at the other end of the tubing. The transducer may be either a microphone or a hearing aid receiver. The electroacoustic transducer, being too large for direct placement within the middle ear cavity may be located elsewhere in the skull, such as behind the ear adjacent to the surface of the skin. When connected to a microphone the coupler may be placed within the middle ear cavity behind the tympanic membrane and may be attached to the malleus with a wire hook secured to the coupler diaphragm. When attached to a receiver or vibration sending unit the coupler may be attached to the incus end of the stapes using a porous disc secured to the coupler diaphragm, the porosity of the disc permitting tissue growth and infusion whereby the stapes becomes permanently attached to the disc. The acoustic couplers may be used with a wide range of electronic signal processing and amplification circuitry tailored to the particular patient's hearing loss.

35 Claims, 3 Drawing Sheets

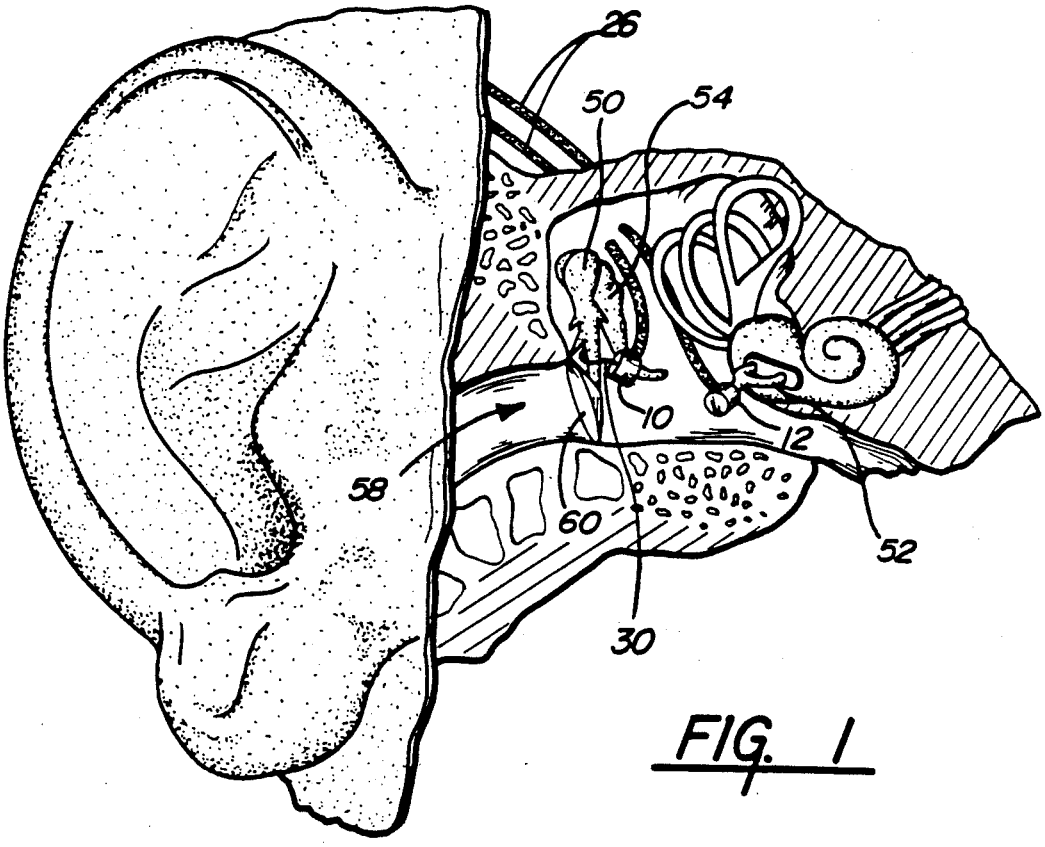
FIG. 1
FIG. 2
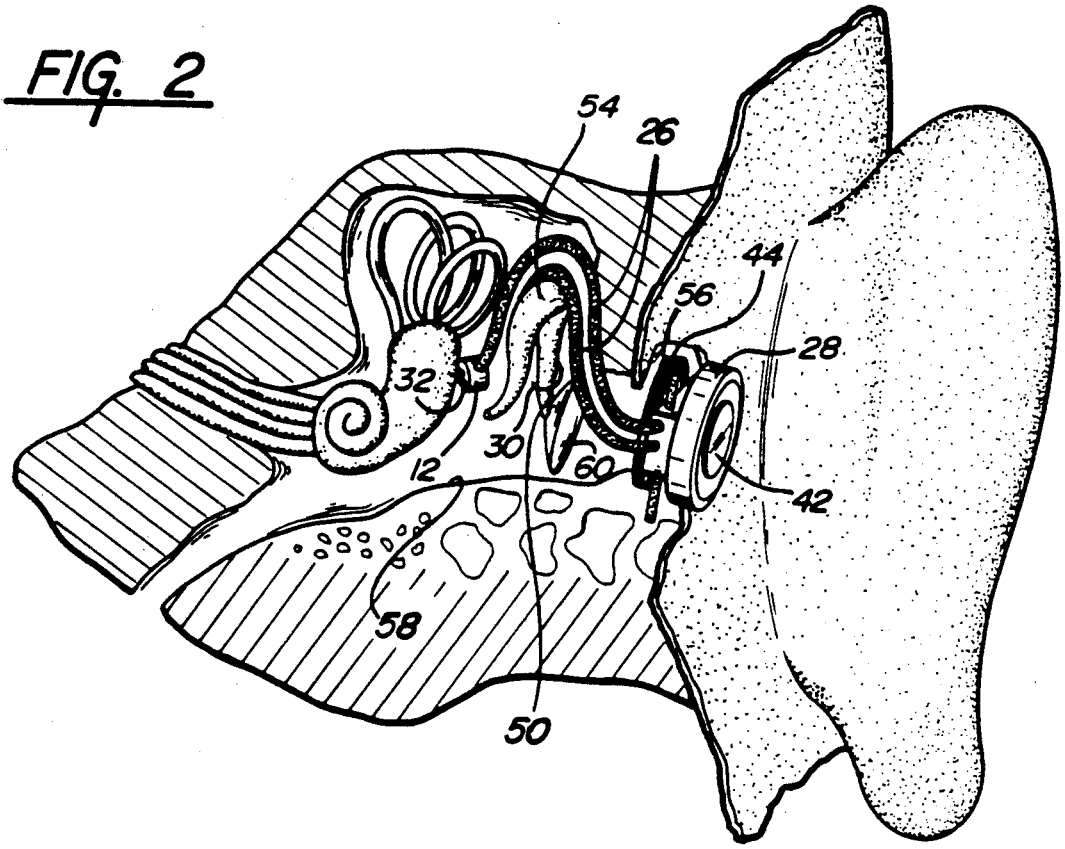

IMPLANTABLE MIDDLE EAR HEARING AID SYSTEM AND ACOUSTIC COUPLER THEREFOR

BACKGROUND AND SUMMARY OF THE INVENTION

The present invention relates generally to the implantable hearing aids and more particularly to implantable hearing aids for direct coupling to the middle ear. The invention may be directly coupled to the cochlea via the stapes or to other elements within the ossicular chain.

The implantable hearing aid is intended to help a specific class of patient for which conventional hearing aids are inadequate. These patients have severe hearing impairments and require excessive amplification that is limited by acoustic feedback and sound distortion. Patients have reported an increased clarity of sound and were able to identify speech equal to or better than that reported with conventional aids by using amplified sound directly coupled to the stapes.

The performance of conventional hearing aids has improved markedly over the past ten years. However, there remains a significant population of hearing impaired patients for whom these aids are inadequate. A previously estimated population of approximately one million in the United States alone have hearing impairments that are characterized by severe hearing loss and a need for high levels of sound amplification. The high power required by these patients is difficult to achieve with the small, inconspicuous receivers used in hearing aids because of the significant mismatch between the acoustic impedance of the receiver and the ear.

Problems with these aids include: (1) inefficient energy conversion resulting in excessive power consumption and short battery life, (2) acoustic feedback resulting in oscillation and squeal, and (3) distortion of the signal from a variety of factors resulting in reduced clarity of sound and reduced speech intelligibility.

Due to impedance mismatch, conventional aids are inefficient. It has been documented that at a sound pressure of 100 dB SPL the acoustic power absorbed by the ear is about 0.1 microwatt. The corresponding electrical power supplied to the hearing aid receiver operating at this level is about 0.3 milliwatts (300 microwatts). The conversion efficiency is less than 0.3 percent. In contrast, the conversion efficiency of a well designed acoustic horn and driver is between 10 percent and 50 percent. This sizable discrepancy in efficiency between the hearing aid and horn driver is a direct consequence of the relative impedances of the transducer and the acoustic impedance of the load on the transducer. By coupling directly to the stapes, a better impedance match is achieved and the system can be made more efficient. A tenfold improvement in efficiency would result directly in extending the battery life of the aid.

A second problem with conventional high-power hearing aids is acoustic feedback. In order to isolate the output of the aid from the input microphone, patients are required to wear tightly-fitting earmolds. These tightly-fitting earmolds are uncomfortable for the patient and the complete occlusion of the ear canal causes an unpleasant sensation and initially makes the patient's own voice sound unnatural. In addition, the amount of isolation that can be achieved with a closed earmold is limited by the acoustic properties of available materials and even the best fitting earmold will lose its seal as a result of jaw motion and external ear movement. These problems can be solved with the use of direct vibratory stimulation of the stapes. Although some sound will radiate from the cochlea, it will be greatly attenuated because of the small impedance of the ear canal versus the higher acoustic impedance of the transducer and fluid-filled cochlea.

A third problem with conventional hearing aids is the distortion produced by the receiver and the middle ear at high sound pressures. Distortion results in a loss of clarity of sound and a reduction in speech intelligibility for the patient. It has been illustrated that a speech hearing loss due to attenuation can be corrected with amplification, whereas a speech hearing loss due to distortion cannot. The distortion inherent in an abnormally functioning inner ear makes it impossible for the patient to recognize individual phonemes of speech with 100 percent accuracy under quiet listening conditions. When this inherent distortion is coupled with that caused by conventional hearing aids (i.e., acoustic feedback, acoustic resonances and antiresonances due to receiver and connective tubing and middle ear distortion) the sum of the individual sources of distortion on speech intelligibility is similar to that of decreasing the speech-to-noise ratio at the input to the hearing aid. Since a normal hearing individual has only a margin of 8 dB in a typical noisy environment such as a busy department store or restaurant, an equivalent loss of 8 dB due to distortion can become a major handicap. As previously mentioned, with middle ear vibrators, patients have reported that the sound perceived via direct stimulation of the stapes is clearer and less distorted when compared with the sound produced by conventional aids. From these results it appears that driving the stapes directly can eliminate much of the distortion of conventional aids.

Concerning utility, an important aspect of hearing aid design is its utility for the wearer which includes factors such as patient comfort, convenience of use, sound quality and aesthetics. Utility of the design plays an important role in patient acceptance and must be included in the evaluation of a device. In the past, the emphasis on whether an aid is satisfactory has been determined primarily by speech intelligibility testing. Previous evidence implies that if a patient is given a choice, he will prefer to operate the aid (initially) at a setting that provides better sound quality rather than maximum intelligibility. In the same way, patients are likely to prefer to wear a device that is more comfortable and less conspicuous. These issues of utility can be best served by an implantable hearing aid. However, presently available microphones (acoustical-to-electrical transducers) and receivers (electrical-to-acoustical transducers) are too large and ill-suited for placement within the middle ear.

The present invention makes it possible to use existing transducers, without significant modification to the middle ear while retaining the advantages of implanted middle ear assistance devices. The present invention provides an acoustic coupler which is preferably hermetically sealed for direct insertion into the middle ear cavity. The acoustic coupler is sized to fit within the middle ear cavity without significant surgical alteration of the cavity. It can be attached to a microphone located remote from the middle ear cavity for acoustically coupling the microphone with the malleus or the tympanic membrane. The coupler may also be used in reverse when attached to a receiver to act as a vibrator for causing mechanical vibration of the stapes.

The acoustic coupler comprises a chamber-forming member across which a compliant diaphragm or membrane is attached. Connective tubing couples the chamber with a selected electroacoustic transducer (e.g., microphone or receiver). The connective tubing is preferably acoustically matched so that a substantially constant acoustical impedance is maintained. The presently preferred connective tubing system includes a tuning portion forming a terminated or closed end, resonant at even harmonics and an open end, resonant at odd harmonics. The resultant acoustical coupler is suitable for direct placement within the middle ear cavity and serves an acoustical coupling for transmission of acoustical energy between the coupler diaphragm at one end and the electroacoustic transducer at the other. The coupler diaphragm may be physically coupled to the handle of the malleus by a wire hook or it may be positioned to acoustically couple with the tympanic membrane when used as a microphone. When used as a transmitter or vibrator the diaphragm can be physically attached to the stapes via an intermediate wafer adhered to the membrane and also attached to the stapes. Preferably the wafer is porous such as ceramic and becomes fused to the stapes by tissue growth.

For a more complete understanding of the invention, its objects and advantages, reference may h=had to the following specification and to the accompanying drawings.

BRIEF DESCRIPTION OF THE DRAWINGS

FIGS. 1 and 2 illustrate, respectively, front and rear views of the human ear with one form of the invention implanted therein;

DESCRIPTION OF THE PREFERRED EMBODIMENT

Figure 3:
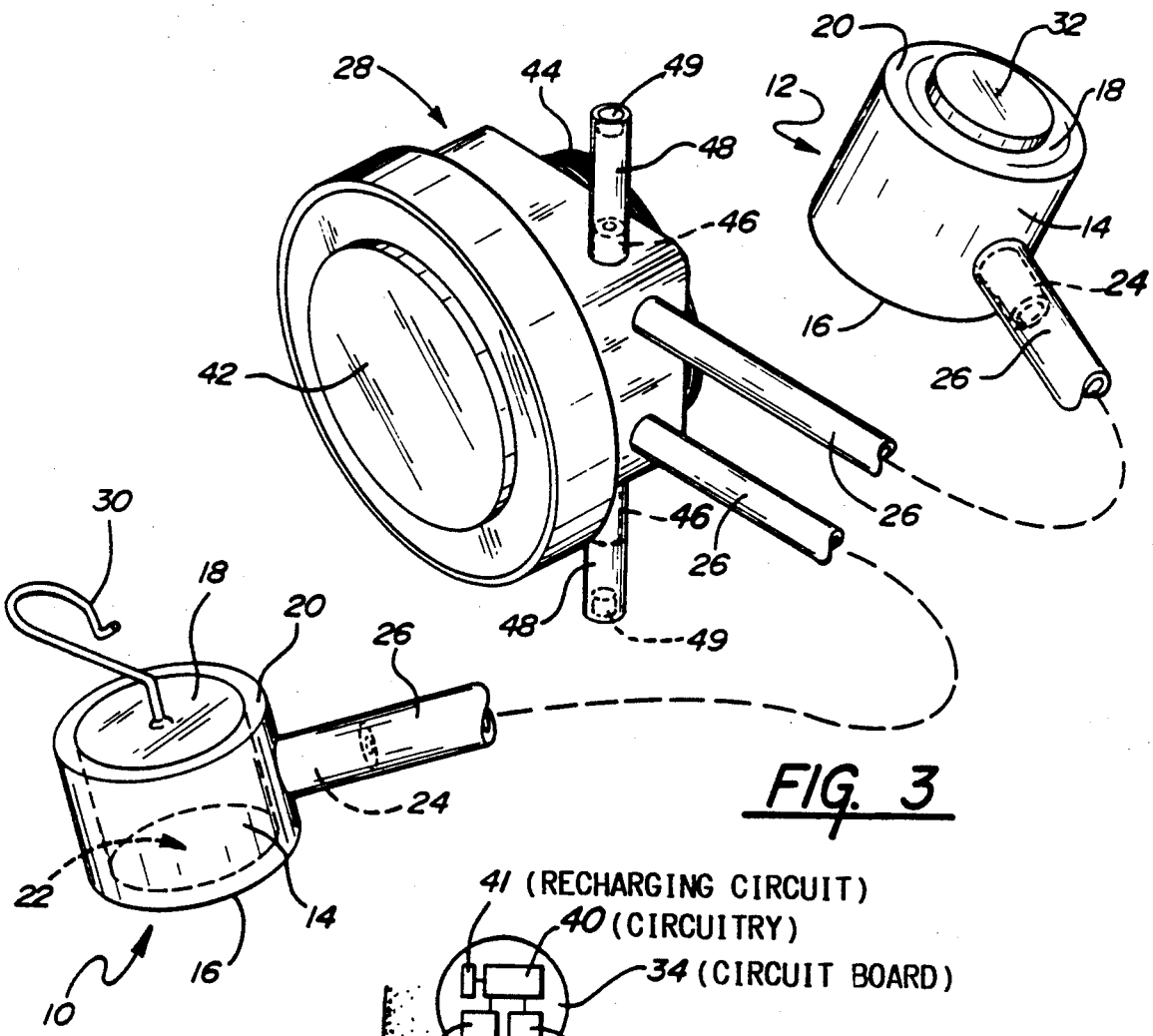
FIG. 3 is a detailed perspective view of the invention in its presently preferred embodiment.

The present invention provides an acoustic coupler which may be used for both sound pick up and sound delivery systems. In order to illustrate both of these uses, FIG. 3 illustrates the presently preferred embodiment in a configuration providing both sound pick up and sound delivery systems. Referring to FIG. 3, a sound pick up coupler 10 and a sound delivery coupler 12 are illustrated. The sound pick up and delivery couplers both comprise a cylindrical containment member 14 with closed end 16. A flexible and compliant diaphragm or membrane 18 is stretched across and sealed to the outer circular periphery 20 of containment member 14 to define a sound chamber 22. Preferably diaphragm 18 is fabricated from a 0.10 xm thick film of synthetic rubber material which can be obtained from Dow Corning Company under the brand name Silastic®. The diaphragm may be affixed to periphery 20 using Silastic® Type A adhesive also available from Dow Corning Company. Although the size may vary somewhat depending upon the application, the containment member is of a sufficiently small size to fit within the middle ear cavity, generally as illustrated in FIGS. 1 and 2. The presently preferred containment member has an outer diameter of 3.00 xm when measured across circular periphery 20. The diaphragm is attached to the circular periphery without placing the diaphragm under tension, so that the resulting installed diaphragm is free to flex up and down in the auditory frequency range.

Containment member 14 is provided with a nipple 24 which communicates with sound chamber 22 and which receives the end of a length of tubing 26. Tubing 26 is coupled at the opposite end to the sound reinforcement and processing package 28, which is preferably located outside the middle ear cavity as illustrated in FIGS. 1 and 2. Although the presently preferred containment member 14 and tubing 26 are air filled, other fluids may be used.

When used as a sound pick up, such as pick up coupler 10, a wire hook 30 can be attached as with adhesive to the center of diaphragm 18. The hook is shaped to attach to one of the ossicular bones within the ear and serves to physically couple movement of the ossicular chain to diaphragm 18, to thereby introduce acoustical energy into sound chamber 22, allowing transmission of the acoustic energy through tubing 26 to microphone 36.

When used as a sound delivery coupler, such as coupler 12, diaphragm 18 is provided with a disc 32, suitably secured to the diaphragm as with adhesive. The disc is preferably porous or fibrous material, such as ceramic and is intended to be placed in contact with a selected ossicular bone, the porous nature of the disc permitting tissue to grow into and fuse with the disc. The disc thereby couples acoustical energy carried by movement of diaphragm 18 to the desired ossicular bone for further processing by the human ear. Although the current embodiment uses a stiff ceramic disc, a compliant disc may decrease the restriction of diaphragm movement caused by gluing a ceramic disc in the center.

It is to be understood that the above-described means of attachment to the selected ossicular bones are presently preferred, although there are other alternate means for effecting acoustical coupling between the diaphragm and the ossicular member of interest. Intermediate lever arms may be used to couple the diaphragm to an element of the ear, for example. Also, where direct physical coupling is not required, pick up coupler 10 can be fashioned without wire hook. In this instance, the diaphragm 18 is positioned within the middle ear either in contact with or behind the tympanic membrane of the ear so that movement of the tympanic membrane imparts a corresponding movement in diaphragm 18 by direct contact in the first case or by sound pressure variations in the entrapped air volume of the middle ear in the second case. In such an application, it may be necessary to give attention to placement of the coupler so that it does not lie on a standing wave null point within the middle ear cavity.

Furthermore, while the porous or fibrous disc is the presently preferred means for attachment to the stapes, oval window or other ossicular member, other techniques can employed. For example, the diaphragm may be attached to the stapes using magnets. A first magnet is attached to the diaphragm 18, on either the inner surface or the outer surface, and a bumper of ferrous material is adhered to the stapes. The magnet and ferrous bumper are attracted to one another by the Newton traction force and create a mechanical coupling between the membrane and the ossicular member. Adhesive materials can also be used to attach the diaphragm directly to the stapes or other ossicular member.

Figure 4:
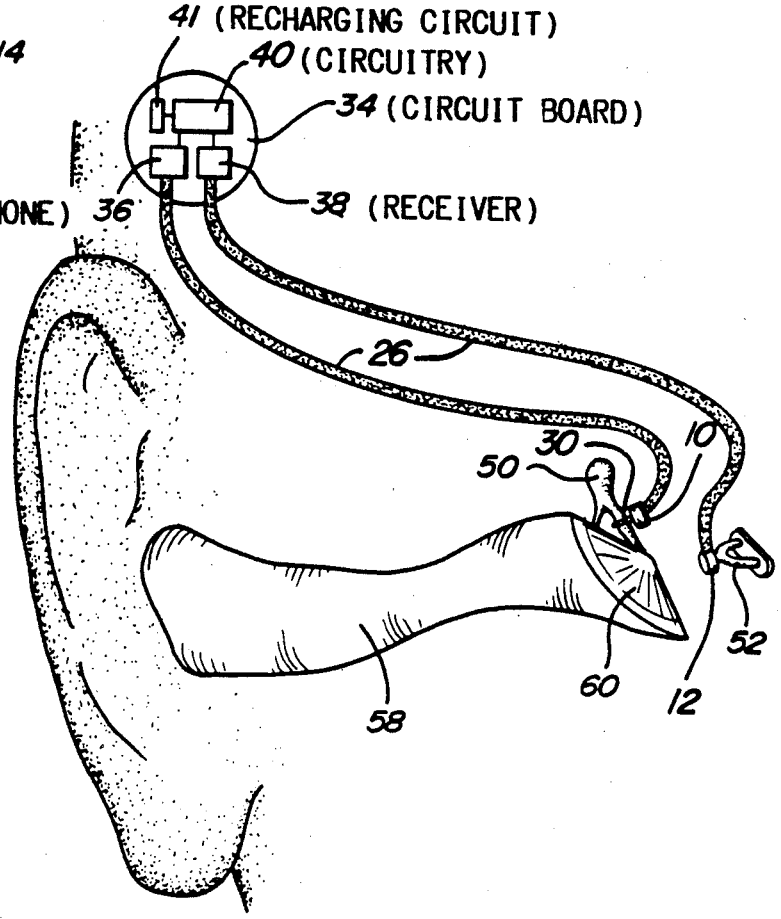
FIG. 4 is a schematic view illustrating the invention in use.

The sound reinforcement and processing package 28, also illustrated in FIG. 4, preferably comprises a circuit board or substrate 34 to which a miniaturized microphone 36 and hearing aid receiver 38 are attached. The microphone and receiver are electrically connected to the desired amplification and signal processing electronic circuitry 40 which may be embodied in integrated circuits surface mounted or otherwise attached to circuit board 34. To provide electrical power for operating the electronic circuitry, a battery 42 (FIG. 3) is secured to and electrically connected to one side of circuit board 34. Preferably the battery is rechargeable and the electronic circuitry includes an inductively coupled circuit means 41 for recharging the battery. In this regard, circuit 41 includes an electromagnetic coil 44 provided as part of the package 28 (FIG. 3). The coil is positioned near the surface of the skin of the patient and forms the secondary windings of a transformer. When it is desired to recharge battery 42, an external coil is placed on or near the skin adjacent the secondary coil 44 forming the primary windings of a transformer. The primary and secondary coils are electromagnetically coupled with one another to form a transformer through which electrical energy is conveyed to charge battery 42.

In order to provide proper termination and to smooth standing wave resonances at both the microphone 36 and receiver 38, microphone 36 and receiver 38 are each provided with a fitting 46 which communicates with the interior cavity of the microphone and receiver, respectively. In FIG. 3 two such fittings 46 are illustrated, one communicating with the microphone and one communicating with the receiver (both housed within package 28). A short length of tubing 48 is attached to each fitting and the opposite end of the tubing is fitted with a ceramic plug 49 serving to close the end of the tubing. This short length of tubing, along with the sound delivery tube to the chamber and dampers with impedance equal to the characteristic impedance of the tubing, provides a relatively constant acoustical impedance for proper termination of the microphone and receiver units. The closed end of tubing 48 provides proper termination of the even harmonics, whereas the tubing 26 connected to the coupler acts as an open-ended tubing, thereby providing a good acoustical match at the odd harmonics. By providing both even and odd harmonic matching, a substantially constant acoustical impedance results with a sufficiently wide bandwidth for conveying acoustical signals in the human hearing range. For more information on the use of acoustic termination see E. V. Carlson, "Smoothing The Hearing Aid Frequency Response," *Journal of the Audio Engineering Society*, July/August 1974, Vol. 22, No. 6.

FIGS. 1 and 2 illustrate an exemplary use of the invention wherein pick up coupler 10 is attached by means of hook 30 to the malleus 50. The delivery coupler 12 is attached by means of ceramic disc 32 to the incus end of the stapes 52. As illustrated, the ossicular chain is dearticulated by disconnecting two of the ossicular bones, such as at the connection between stapes 52 and incus 54. The incus 54 may be removed to provide space and so as not to interfere with movement of the stapes now under control of delivery coupler 12. Pick up coupler 10 is held in place by hooking onto the malleus and delivery coupler 12 is held in place by affixing to a bone pin, or the like, secured to the bone mass adjacent the middle ear cavity. The couplers may be installed by making the appropriate incision and opening behind the ear as illustrated in FIG. 2 at 56. Opening 56 may then be used to receive the sound reinforcement and processing package 28, with either the secondary coil 44 or battery 42 being positioned immediately beneath the skin.

In use, the exemplary acoustic coupler sound pick up and delivery system works as follows. Sounds enter the ear canal 58 and impinge upon the tympanic membrane 60, causing it to vibrate. The tympanic membrane, being attached to the malleus 50 thus imparts vibratory movement to the malleus. In a normal ear this movement of the malleus is transmitted through the incus 54 to the stapes. However, since the incus and stapes have been dearticulated, this movement is no longer communicated through to the stapes. Instead, movement of the malleus acts through hook 30 to cause the diaphragm 18 of pick up coupler 10 to vibrate. Vibration of the pick up coupler diaphragm causes changes in the sound pressure levels within the sound chamber 22 of the pick up coupler. These pressure changes are transmitted through tubing 26 to the microphone 36. Microphone 36 converts the sound pressure level changes into electrical signals which are processed by the amplification and signal processing circuitry 40 in accordance with the needs of the particular patient.

In many cases, the signals will be amplified and may be additionally filtered to emphasize or de-emphasize various frequency ranges. Either analog or digital processing of the electrical signals can be employed. For example, if the patient has a profound hearing loss at most speech frequencies but has normal hearing at the low and high end of the human hearing spectrum, then the signal processing would increase the amplitude of signals at the speech frequencies while leaving the remaining frequencies unchanged. Using digital techniques, the electronic signal processing can be quite precise and quite frequency-selective, as needed. The objective of this signal processing is to provide a signal which compensates for deficiencies in the patient's hearing, in an effort to provide as much hearing as is possible.

After electronic amplification and signal processing, the electrical signal is fed to receiver 38 which converts the electrical signals back into sound pressure level changes which are then coupled through the delivery coupler tubing 26 to the delivery coupler 12. The sound pressure level changes within delivery coupler 12 cause the corresponding diaphragm 18 and ceramic disc 32 to vibrate at an amplitude and frequency corresponding to the amplitude and frequency of the sound waves which entered the ear canal (as modified by the electronic processing). This vibration is transmitted to the stapes which then acts in usual fashion.

Figure 5:
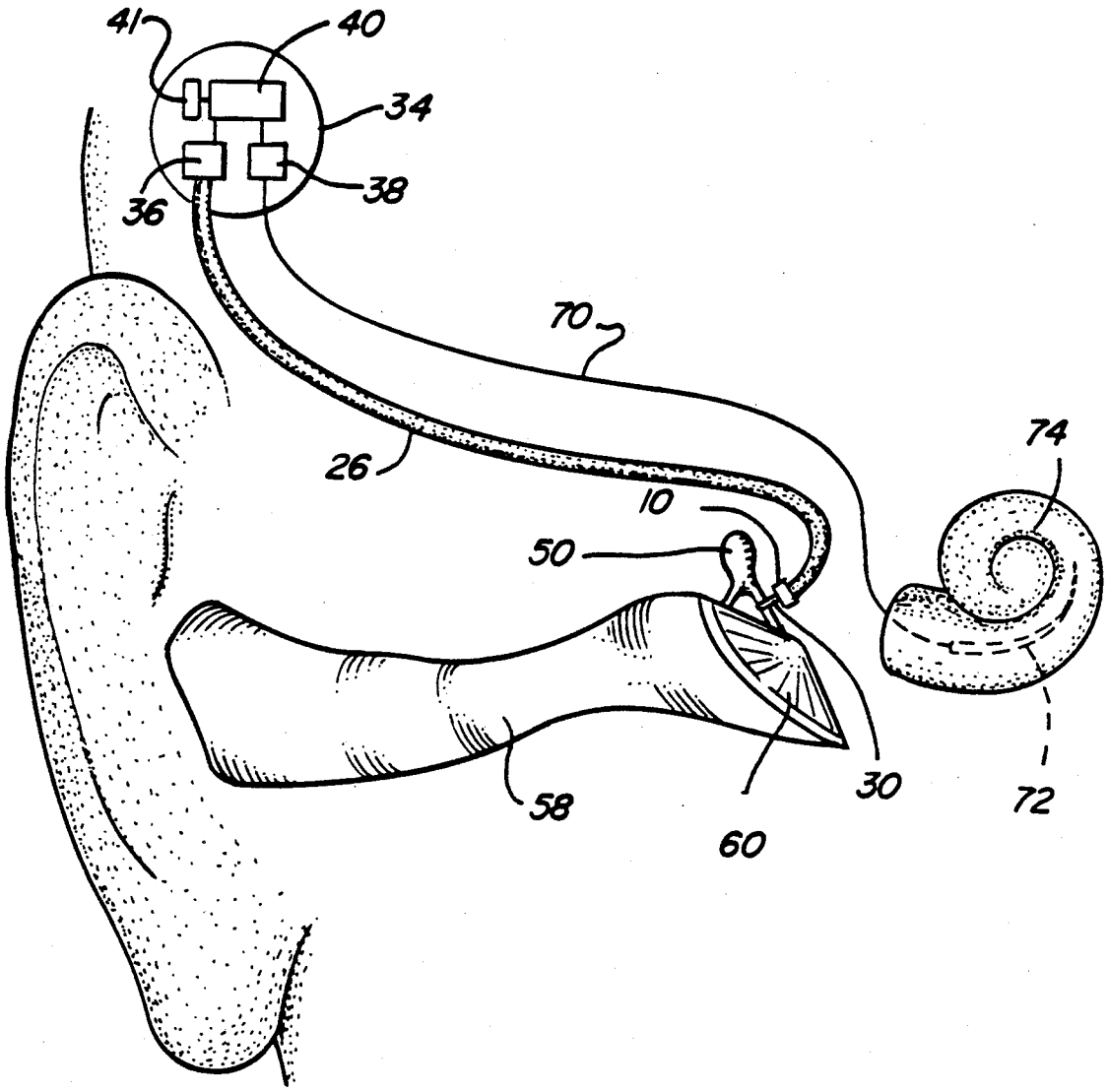
FIG. 5 is a schematic view illustrating another embodiment of the invention.

From the foregoing it will be seen that the present invention provides a solution to the problem of electromechanical transducer placement within the middle ear cavity. While the invention has been illustrated in an application utilizing both a sound pick up and a sound delivery system, the invention may be adapted for other uses as well. For example, if direct stimulation of the cochlea is to be implemented, the sound delivery coupler may be eliminated, with the electrical signals from the sound reinforcement and processing package going directly to a cochlear implant. Such a system is shown in FIG. 5 where the electrical signals from the receiver 38 are transmitted through a wire or conduit 70 to an implant 72 positioned in the cochlea 74. Accordingly, it should be understood that the present invention is capable of certain modifications without departing from the spirit of the invention as set forth in the appended claims.

What is claimed is:

1. An acoustic coupler for an implantable hearing aid system for the middle ear, the system having a signal processing unit, the acoustic coupler comprising:

sound chamber means having two ends;

diaphragm means enclosing one end of said sound chamber means;

means for attaching said diaphragm means to a middle ear member; and means for coupling said sound chamber means to said signal processing unit.

2. The acoustic coupler as set forth in claim 1 wherein said means for coupling said sound chamber means to said signal processing unit comprises tubing means for conveying acoustic signals.

3. The acoustic coupler as set forth in claim 1 wherein said signal processing unit comprises an electroacoustic transducer.

4. The acoustic coupler as set forth in claim 3 wherein said transducer includes a microphone.

5. The acoustic coupler as set forth in claim 3 wherein said transducer includes a receiver.

6. The acoustic coupler as set forth in claim 1 wherein said diaphragm is a silastic membrane.

7. The acoustic coupler as set forth in claim 1 wherein said means for attaching said diaphragm to a middle ear member comprises hook means.

8. The acoustic coupler as set forth in claim 1 wherein said means for attaching said diaphragm to a middle ear member comprises a porous disc means and said disc means is attached to said diaphragm by tissue of bone infusion.

9. The acoustic coupler as set forth in claim 8 wherein said disc means is a ceramic material.

10. The acoustic coupler as set forth in claim 1 wherein said means for attaching said diaphragm to a middle ear member comprises adhesive means.

11. The acoustic coupler as set forth in claim 1 wherein said means for attaching said diaphragm to a middle ear member comprises magnetic means.

12. The acoustic coupler as set forth in claim 11 wherein said magnetic means comprises a first magnet member attached to said diaphragm and a second magnet member attached to said middle ear member.

13. The acoustic coupler as set forth in claim 1 wherein said middle ear comprises a plurality of members from the group consisting of the tympanic membrane, the oval window, and the ossicular bone chain.

14. The acoustic coupler as set forth in claim 13 wherein said ossicular bone chain comprises the malleus, the incus and the stapes.

15. The acoustic coupler as set forth in claim 1 wherein said means for attaching said diaphragm to a middle ear member comprises lever means.

16. The acoustic coupler as set forth in claim 1 wherein said signal processing unit includes electrical power means, signal processing circuitry and at least one electroacoustic transducer.

17. The acoustic coupler as set forth in claim 16 wherein said electrical power means is rechargeable and wherein said signal processing unit further comprises means for recharging said electrical power means.

18. The acoustic coupler as set forth in claim 16 further comprising means for smoothing the standing wave resonance in said transducer.

19. The acoustic coupler as set forth in claim 16 further comprising means for providing substantially constant acoustical impedance for said transducer.

20. The acoustic coupler as set forth in claim 16 wherein said transducer comprises a microphone.

21. The acoustic coupler as set forth in claim 16 wherein said transducer comprises a receiver.

22. The acoustic coupler as set forth in claim 16 wherein said signal processing circuitry includes amplification means.

23. The acoustic coupler as set forth in claim 1 wherein said attaching means comprises hook means secured to said diaphragm for connection to an ossicular bone within the middle ear.

24. An implantable hearing aid system for the middle ear, said system comprising signal processing means, at least one acoustic coupler, coupling means for connecting said acoustic coupler to said signal processing means, and attachment means for connecting said acoustic coupler to a middle ear member, each of said acoustic couplers having sound chamber means and a flexible diaphragm enclosing one end of said chamber means.

25. The implantable hearing aid system as set forth in claim 24 wherein said coupling means comprises tubing means and said signal processing means comprises at least one electroacoustic transducer means.

26. The implantable hearing aid system as set forth in claim 24 wherein said attachment means comprises a hook means attached to said diaphragm.

27. The implantable hearing aid system as set forth in claim 26 wherein said hook means is secured to said diaphragm for connection to an ossicular bone within the middle ear.

28. The implantable hearing aid system as set forth in claim 24 wherein two acoustic couplers are provided, said signal processing means includes two electroacoustic transducers, and coupling means are provided to separately connect each of said acoustic couplers to said signal processing means.

29. The implantable hearing aid system as set forth in claim 28 wherein one of said two transducers is a microphone, the other of said two transducers is a receiver, and said coupling means comprises tubing means for conveying acoustic signals.

30. The implantable hearing aid system as set forth in claim 29 wherein one of said two acoustic couplers has means thereon for connection to a first ossicular bone within the middle ear and said other of said two acoustic couplers has means thereon for connection to a second ossicular bone.

31. The implantable hearing aid system as set forth in claim 24 further comprising cochlear implant means and means for electrically connecting said signal processing means to said cochlear implant means.

32. An acoustic means for sound pick-up or sound delivery for use in an implantable hearing aid for the middle ear, said acoustic means comprising a chamber, a diaphragm connected to said chamber, acoustic tube means connected to said acoustic means, and attachment means on said diaphragm for connection to an ossicular bone in the middle ear.

33. An implantable hearing aid for the middle ear comprising signal processing means;

said signal processing means including a microphone transducer means, signal processing circuitry and power means;

first acoustic coupler means;

said first acoustic coupler means comprising a sound chamber means, diaphragm means, and means for attaching said diaphragm to a first middle ear member; and first coupling means for acoustically connecting said first acoustic coupler means to said microphone transducer means;

whereby sound vibrations in said first middle ear member are transmitted from said first acoustic coupler means to said microphone transducer means for generation of a resultant signal means by said signal processing means.

34. The implantable hearing aid as set forth in claim 33 further comprising receiver transducer means in said signal processing means;

second acoustic coupler means;

said second acoustic coupler means comprising sound chamber means, diaphragm means, and means for attaching said diaphragm to a second middle ear member; and second coupling means for acoustically connecting said second acoustic coupler means to said receiver transducer means;

whereby after sound vibrations from said first middle ear member are processed in said signal processing means, said resultant signal means is transmitted to said receiver transducer means for transmission to said second acoustic coupler means and to said second middle ear member.

35. The implantable hearing aid as set forth in claim 33 further comprising cochlear implant means and means for transmitting said resultant signal means to said cochlear implant means.

* * * * *

UNITED STATES PATENT AND TRADEMARK OFFICE

CERTIFICATE OF CORRECTION

PATENT NO. : 4,988,333

DATED : January 29, 1991

INVENTOR(S) : A. Maynard Engebretson et al

It is certified that error appears in the above-identified patent and that said Letters Patent is hereby corrected as shown below:

Column 1, line 14; "patient" should be --patients--

Column 3, line 28; delete "h=" and insert --be--

Column 3, line 58; "0.10 xm" should be --0.10 mm--

Column 3, line 68; "3.00 xm" should be --3.00 mm--

Column 4, line 60; After "can" insert --be--

Column 7, line 37; "of" should be --or--

Signed and Sealed this

Twenty-fifth Day of August, 1992

*Attest:*

DOUGLAS B. COMER

*Attesting Officer*

*Acting Commissioner of Patents and Trademarks*